United States Patent [19]

Porter

[11] Patent Number: 5,067,331

[45] Date of Patent: Nov. 26, 1991

[54] WARP KNIT FABRIC STRUCTURE AND METHOD OF PRODUCTION

[76] Inventor: Allan W. H. Porter, Stosswald 1290, C.H.9062 Lustmühle A.R., Switzerland

[21] Appl. No.: 701,683

[22] Filed: Mar. 11, 1991

Related U.S. Application Data

[63] Continuation-in-part of Ser. No. 432,363, Nov. 6, 1989, abandoned.

[51] Int. Cl.[5] ..... D04B 21/00

[52] U.S. Cl. ..... 66/195

[58] Field of Search ..... 66/202, 203, 195

[56] References Cited

U.S. PATENT DOCUMENTS

| | | | |
|---|---|---|---|
| 3,422,641 | 1/1969 | Skrepek et al. | 66/195 |
| 3,738,125 | 6/1973 | Blezard et al. | 66/195 |

FOREIGN PATENT DOCUMENTS

| | | | |
|---|---|---|---|
| 10910 | 6/1961 | Taiwan | 66/195 |
| 815096 | 3/1981 | U.S.S.R. | 66/195 |

*Primary Examiner*—Werner H. Schroeder
*Assistant Examiner*—John J. Calvert

[57] ABSTRACT

A warp knit fabric structure formed by means of a single needle and a single guide bar made upon short hook needles of the latch or compound type in which one thread only is supplied to each needle and two, three, four or more needle wale overlaps are made at every course and only the last part of the overlap next to the guide eye forms a single knit loop on the needle of each last wale crossed, and by means of the geometrical settings of the machine knitting elements, the adjacent threads individual single needle loops, or the use of a point comb, the preceding part of each overlap is prevented from forming knit loops on the needles. This part of the overlap is divided into two components, a weftwise fabric linking traverse, and a residual warpwise part held in the adjacent wales by the double thread crossing of the neighbouring threads on each needle in every course of knitting, the fabric structure with only one single knit loop to each needle wale in each course, is obtained with bulk, fullness, and directional stability.

5 Claims, 2 Drawing Sheets

WARP KNIT FABRIC STRUCTURE AND METHOD OF PRODUCTION

This is a continuation-in-part of application Ser. No. 07/432,363 filed Nov. 6, 1989, now abandoned.

BACKGROUND OF THE INVENTION

The Invention relates to a single needle and a single guide bar warp knit fabric structure. This fabric is made using short hook needles of the latch or compound type to acheive the directional stability by this method of production. The simplest form of warp knit structure is derived from a system of parallel threads of yarn led from a warp beam through individual thread guide eyes mounted on a single guide bar. One thread for each needle is laid simultaniously as overlaps in front of the needle hooks.

The fabric is composed of courses of loops connected across the width of the fabric by the underlap threads and with wales of loops parallel to each other up the length of the fabric. The fabric produced is loose and flexible with low bulk and stability. A thread break or dropped stitch may give rise to a hole or ladder run down the wale resulting in two seperate pieces of fabric. Despite the economic length of thread employed the fabric has limited technical and commercial use.

It is known that thread lapped over two needle wales at each course produces two loops at every needle. More stability and bulk is acheived but there are problems of equal thread distribution to each needle as loops are drawn into the wales at every course.

It is also known lapping yarns over three needle wales at each course by using yarns with elastic characteristics. This process allows some loop length correction between wales. The stability and bulk of the fabric is further improved with three loops on each needle at every course.

Each of the above methods with one thread for each needle increases the length of thread used. This is the result of each wale receiving the number of loops equal to the wales overlapped at each course.

SUMMARY OF THE INVENTION

According to the invention a warp knit fabric structure is formed by means of a single needle and a single guide bar. The fabric comprising one thread forming a single knit loop only for each needle wale with the last part of each overlap thread traversed in front of the needle hooks. The overlaps extend from the fabric to the guide eye diagonaly across, intercepting each needle, at geometricaly progressively higher levels, with the needles in their highest position above the fabric. The last part of each thread next the guide eye forms a single knit loop laid across the needle of the last needle wale traversed by each thread as overlaps across two, three, four or more needle wales at every course of knitting. This leaves the preceding part of the overlap laid across the wale or wales before the last to be traversed by each thread at each course being prevented from forming knit loops by the geometrical settings of the machine knitting elements, the adjacent threads individual single needle loops, or the use of a point comb. The overlap part next the fabric serves to link the wales traversed by them into a fabric structure. This part of the overlap not forming knit loops is held by at least two threads crossing the knit loops of the adjacent threads. These threads form the adjacent wales at the top of the loop in the previous course. The part of the overlap not forming knit loops is held by the loops of the adjacent wales into two components. The one across the wales has the function of connecting them, whilst a prior residual part, which lies up the wale where it formed its previous loop, give together a warpwise and weftwise effect on the technical back of the fabric at every course. Each thread crosses at least twice the weftwise traverse and holds the thread from the adjacent wale reducing the possibility of a ladder run due to a thread break or a dropped stitch. The fabric structure produced by this method has bulk, fullness and directional stability previously not obtained in a knit fabric with only one thread and knit loop for each needle wale and course. The fabric structure as set out with overlaps ending in a single open knit loop in the last wale traversed may be formed so that an underlap preceding a multiple wale overlap ending in a single knit loop in the last wale crossed by the thread can combine in the same course. The underlap closes the loop it formed in the previous course and steps the subsequent overlap a wale left and right alternately at each course. .

DESCRIPTION OF THE ILLUSTRATIVE EMBODIMENTS

Figure 1:
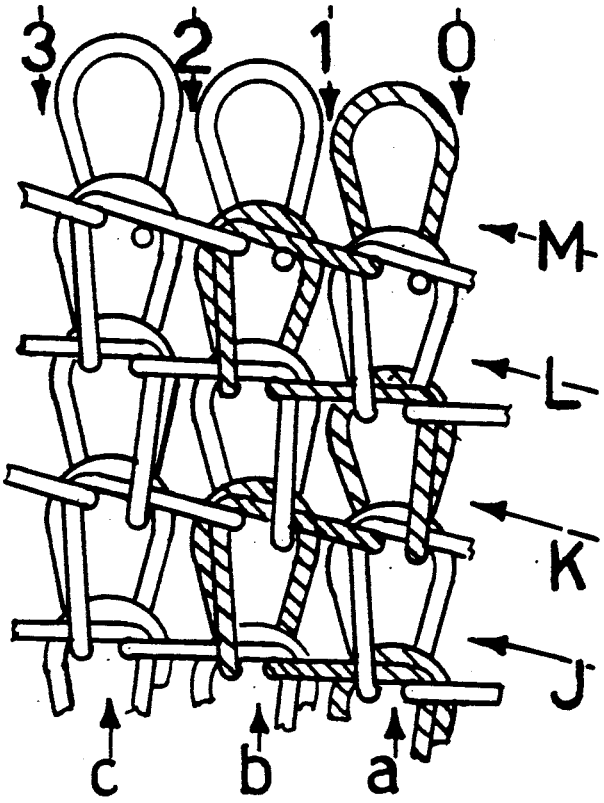
FIG. 1 illustrates diagramaticaly a system of three needle wales, four courses, intervening spaces and formed loops with simple two needle overlaps and single loops in each wale.

The invention will now be described with reference to the drawings in which FIG. 1 illustrates wales "a:b:c", courses "J; K; L; M", and intervening spaces "0, 1, 2, 3", and guide movement "2-0/0-2".

The hatched thread lies in a completed loop in wale "b", course "J". It passes up space "2", then across wales "b:a", into the loop for the next course "K", space "0". It is drawn through the loop in wale "a", course "J", trapping the overlap of the thread to its right.

Figure 2:
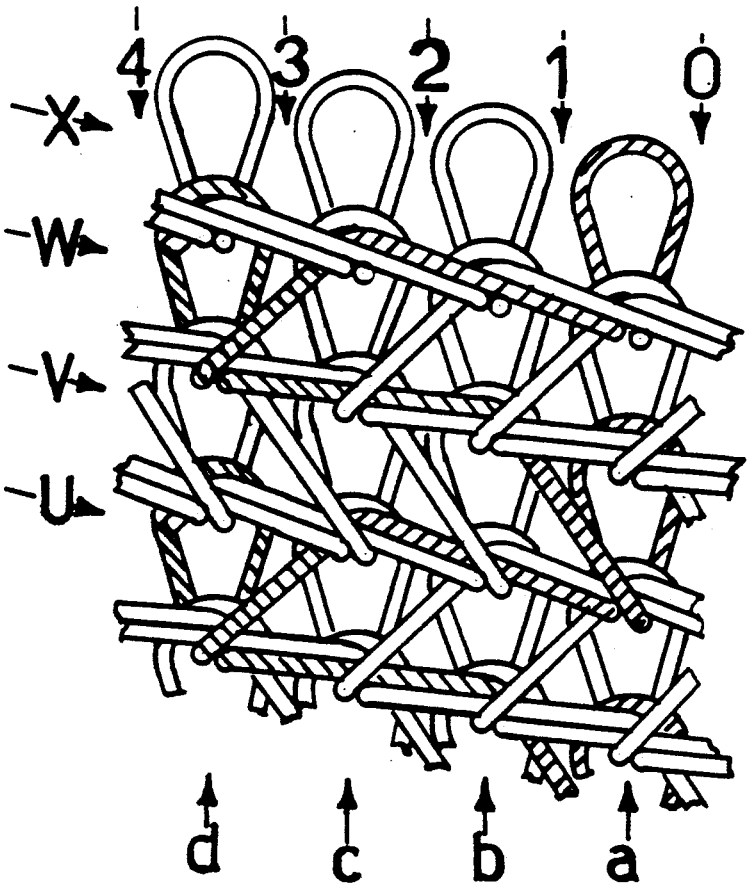
FIG. 2 illustrates the system of four needle wales, four courses, intervening spaces and formed loops from a three needle overlap and one needle underlap and single loops in each wale. One hatched thread shows its path in the structure.

It then passes up space "0", course "K", then left across wales "a:b", and forms the loop "b", course "L", having been drawn through the loop in wale "b", course "K", trapping the thread to its left at the base of this course and being held by the thread to its right in wale "a". It now goes up space "2", to the base of course "M", where it is held by the thread to the left before crossing over wales "b:a", to form the loop in wale "a", course "M". It is drawn through the loop wale "a", course "L", to trap the thread to its right in space "1". The thread guide movement notation to identify the knitted overlap within the conventionaly written longer overlap is as follows: "2-0(kt.1-0)/0-2(kt.1-2)". Referring to FIG. 2 illustrates wales "a:b:c:d", courses "U; V; W; X", intervening spaces "0, 1, 2, 3, 4", and guide movement "3-0/1-4". The hatched thread lies in a loop in wale "d", course "U". It passes diagonaly across wale "d", space "3", as an underlap, then continues to the right as an overlap across wales "c:b:a", to form a single loop in wale "a", course "V".

Figure 4:
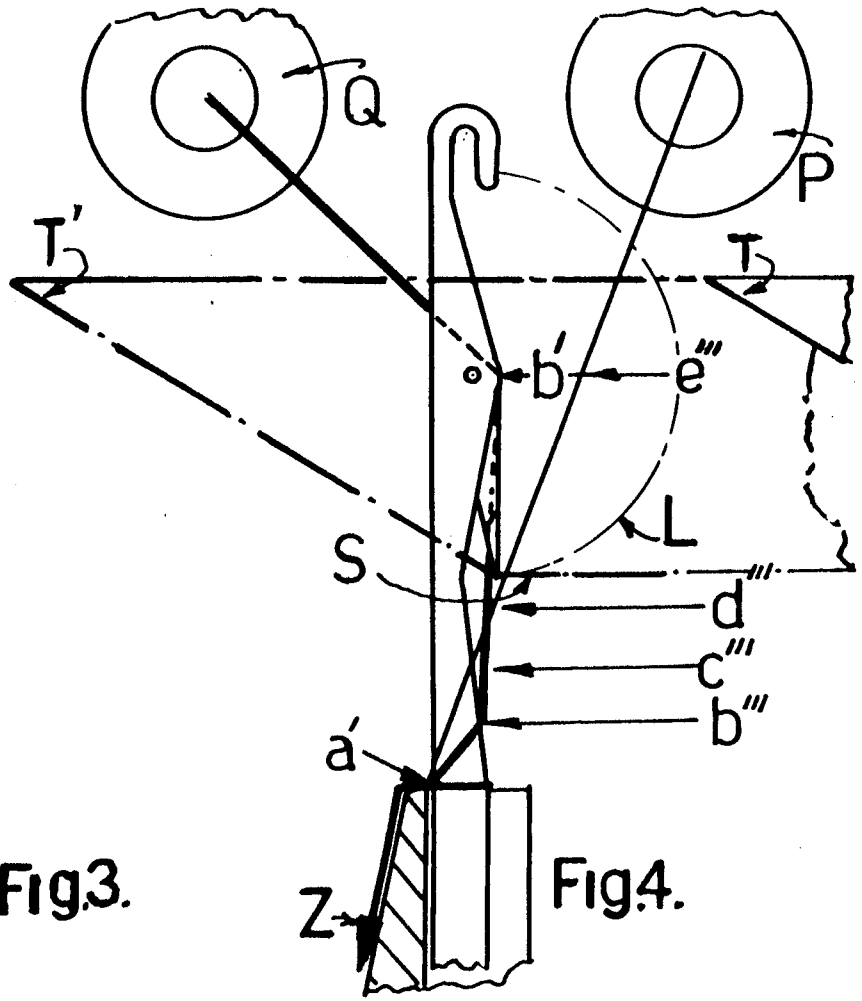
FIG. 4 illustrates an end sectional view of the knitting elements with thread guide "Q" in the underlap, and at "P" in the overlap position. The fabric take down is at "Z".
Figure 3:
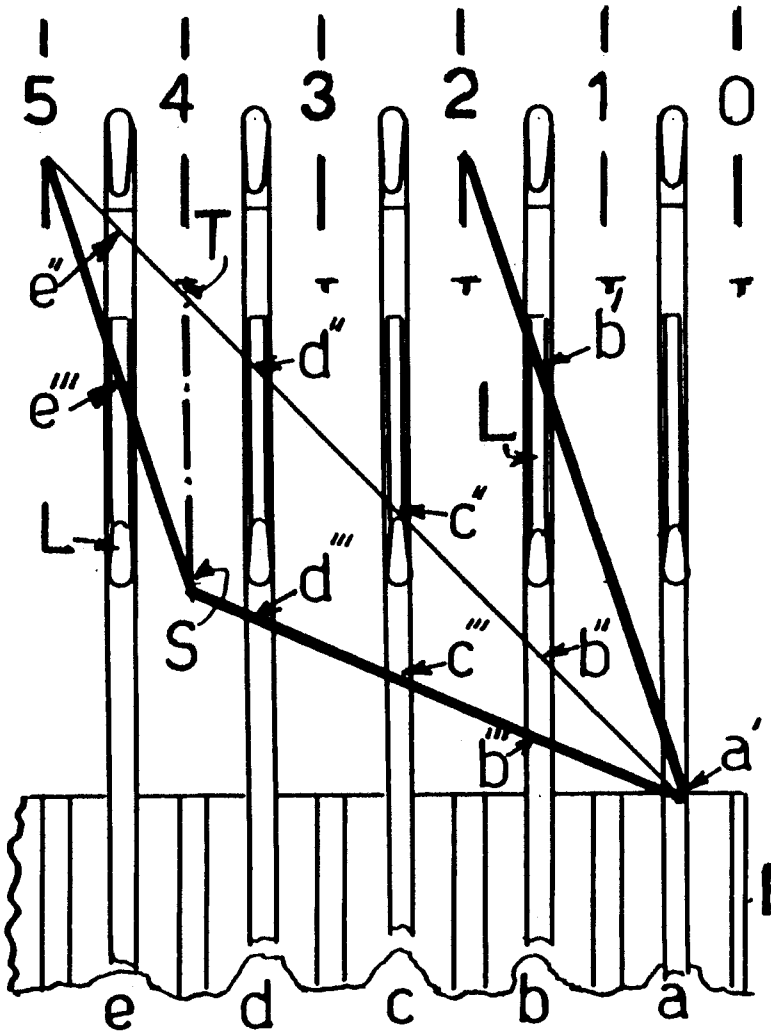
FIG. 3 illustrates five latch needles in their highest position above the fabric looking at the open hooks from the overlap side of the needle plane.

It is drawn through the loop wale "a", course "U", traps the threads to its right from wales "c and b", course "U", and is trapped at the same time by the threads to its left which form loops in wales "c and b", course "V". The thread crosses diagonaly left as an underlap wale "a", space "1", course "V", continues as an overlap across wales "b:c:d", at the base of course "W", where it forms the loop in wale "d", course "W". It traps the threads to its left from wales "b and c", course "V", whilst being trapped by two threads to its right forming loops wales "b and c", course "W". The thread now crosses diagonaly to the right wale "d", space "3", course "W", to the base of course "X", where it continues as an overlap across wales "c:b:a", to form a single loop in wale "a", course "X". The thread is now held by the threads to its left forming loops "c and b", course "X", and holds the threads to its right which previously formed wales "c and b", course "W". The guide movement notation to identify the knit overlap within the conventional longer overlap is as follows: "3-0(kt.1-0)/1-4(kt.3-4)". In FIG. 1 each wale consists of open loops. In FIG. 2 all are closed by the movement of the guide bar forming underlaps. Referring to FIG. 3 the overlap thread across two needle wales "a and b", lies from the fabric loop a' to guide eye "2", with the last part of the overlap next the guide eye intercepting the needle latch at b' capturing it and forming a single knit loop in wale "b". Alternatively a five needle overlap is shown from a' to guide eye "5", with intercepts at b''m c'', d'', e''. The last three intercepts lie on latches "L", and are thrust down the needles by the points of comb "T", to "S", inserted above the overlaps. These now lie from a', b''', c''', d''', S, e''', to "5", leaving the last part next the guide eye on latch "L", at e''', to form a single knit loop. Referring to FIG. 4 guide eye "Q", in the underlap position space "0", passes through the needle plane to "P", where it overlaps the needles and passes back through them in space "2", to "Q", leaving the thread in a rectangular half helix from a', b' to "Q". By a five needle overlap, the intercept heights are a', b''', c''', d''', S, e''', to "Q" space "5", after thrusting the thread from T' to S down the inverted slope of the comb inserted from T to T'. By adjustment of the setting geometry of the machine knitting elements, the guide depth and swing through the needle plane, or use of a pointed comb, the lower first part of the overlap is prevented from forming knit loops because its intercept lies beyond capture by the latch "L", and the last part of the overlap intercept next to the guide eye is captured by the latch "L", to form single knit loops at every course of knitting.

What I claim as new and desire to secure by Letters Patent of the United States is:

1. A warp knit fabric structure formed by means of a single needle and single guide bar comprising one thread forming a single knit loop only for each needle wale with the last part of the thread overlapping across the needle of a last needle wale traversed by each thread as overlaps across two or more needle wales at every course of knitting.

2. A warp knit fabric structure as set forth in claim 1, wherein an underlap preceding the multiple wale overlap ending in a single knit loop in the last wale crossed by the thread can combine in the same course.

3. A warp knit fabric structure as set forth in claim 1, wherein that part of the overlap laid across the wale or wales before the last to be traversed by each thread at each course being prevented from forming knitted loops and serving to link the wales traversed by them into a fabric structure.

4. A warp knit fabric structure as set forth in claim 3, wherein that part of the overlap not forming loops being held by at least two threads crossing the knit loops of adjacent threads which form the adjacent wales at the top of the loop of the wale in the previous course.

5. A warp knit fabric structure as set forth in claim 4, wherein that part of the overlap not forming loops is held by the loops of the adjacent wales into two components one warpwise and the other weftwise at every course.

* * * * *